US007893332B1

(12) United States Patent
Lundberg

(10) Patent No.: US 7,893,332 B1
(45) Date of Patent: Feb. 22, 2011

(54) MUSIC INSTRUMENT STAND

(76) Inventor: Eric R. Lundberg, 7092 Behler Rd., New Tripoli, PA (US) 18066

( * ) Notice: Subject to any disclaimer, the term of this patent is extended or adjusted under 35 U.S.C. 154(b) by 0 days.

(21) Appl. No.: 12/478,836

(22) Filed: Jun. 5, 2009

Related U.S. Application Data

(60) Provisional application No. 61/130,973, filed on Jun. 5, 2008.

(51) Int. Cl.
*G10D 3/00* (2006.01)

(52) U.S. Cl. ..... 84/327

(58) Field of Classification Search ..... 84/387 A, 84/53, 327, 329; 248/309.1, 443; 206/314
See application file for complete search history.

(56) References Cited

U.S. PATENT DOCUMENTS 6,384,307 B1 * 5/2002 Sueta et al. ..... 84/385 A

* cited by examiner

*Primary Examiner*—Kimberly R Lockett
(74) *Attorney, Agent, or Firm*—Charles A. Wilkinson; Clinton H. Wilkinson

(57) ABSTRACT

A support for a wind instrument is formed of a structural-supporting stand having a soft fabric support slung between the structural members of the stand for temporary support of a wind instrument. The structural members of the stand are preferably held together during use by elastic bands extending along certain of the structural members.

14 Claims, 10 Drawing Sheets

MUSIC INSTRUMENT STAND

REFERENCE TO EARLIER APPLICATIONS

This application is based upon and claims priority from U.S. Provisional application Ser. No. 61/130,973 filed Jun. 5, 2008.

BACKGROUND OF THE INVENTION

1. Field of the Invention

This present invention relates generally to the field of music and more particularly to wind instruments and more particularly still to so-called brass wind instruments such as particularly French Horns and the like and more particularly still to a convenient stand for support of such instruments which is both convenient, protective of such instruments and portable.

2. Description of the Related Art

A large variety of musical instrument stands have been made and used in the past for various of the brass wind instruments including saxophones which are technically woodwinds, since they use reed vibrators, but are formed of brass nevertheless, which are frequently or even usually used in bands, orchestras and other like musical groups which play in various locales. It is customary for musicians to own and play their own instrument, not only because each instrument has individual characteristics which the artist or musician must be familiar with to play the most satisfactory and pleasing music, but because of cleanliness considerations and the care necessary to keep instruments in good playing condition. Wind instruments are also fairly expensive, furthermore, and sometimes quite expensive, and have high resale values if maintained in good condition. Most professional and other skilled players are therefore reluctant to simply lay their instrument on the floor of a performing area when not in direct use and in addition, wish to keep their instrument close at hand so it can be quickly picked up and performed upon without excessive bending or stooping or other time wasting motion and wherein the instrument is also easily securable in a safe position while stored, or not in use, where it will not be accidentally kicked, stumbled over or the like.

Some musicians use a musical instrument case, used primarily for carrying the instrument when not playing, for storage between use in an orchestra pit, upon a stage or the like, but such cases are usually bulky and liable to be stumbled over as well as noisy if accidentally kicked or the like and constitute a hazard, not only to the owner, but to other musicians in an emergency or the like.

Metal racks or stands which raise temporarily stored musical instruments off a floor of an orchestra pit or off a stage floor are effective storage means, but have the possibility of scratching or denting delicate metal instruments, particularly highly polished brass instruments and are sometimes inconvenient to carry from one location to another. Metal racks, while usually fairly stable are liable to being kicked or otherwise jarred or knocked over whereupon instruments supported upon them are liable to suffer dents or other damage.

The present inventor, having personal experience with other storage means and recognizing the disadvantages thereof has unexpectedly envisioned and subsequently designed and developed a convenient demountable padded temporary storage rack or holder particularly for brass instruments such as particularly French Horns and the like but usable and convenient for other brass or even other woodwind instruments or other musical instruments having a generally rounded or coiled shape which, by the use of such stand are maintained in a stable sling-type arrangement provided or mounted upon a folding stand. The stand or mounted sling-type support provides a soft padded instrument support member somewhat analogous to a camp stool having a suitable upwardly cupped soft flexible surface upon which a brass instrument can be set in an upright position and maintained safe when not in use, even though not contained in the normal protective case. After use during performances the instrument stand can be folded into a compact state and either placed with the instrument's case or carried separately or slung or attached to the case ready to be carried on or in the usual transportation.

There have been various stands for the support of musical instruments during the time they are not being played, of which the following can be particularly mentioned. However, none known to the present applicant, including the following are like the present applicant's arrangement.

U.S. Pat. No. 1,900,718 issued Mar. 7, 1933 to A. S. Lang discloses a stand holding two instruments including a brass wind instrument and apparently a woodwind instrument. The stand uses a metal clip for the brass instrument and an internal insert for the woodwind both mounted upon a base which can be set out on the floor or can be packed into a case still mounted upon the stand.

U.S. Pat. No. 2,559,739 issued Jul. 10, 1951 to S. H. Sherman shows a collection of rings, which can be splayed out or apart, and hold various horn-type musical instruments, and accessories.

U.S. Pat. No. 3,737,137 issued Jun. 5, 1973 to E. R. Sheehan discloses a guitar stand including a sling arrangement in a "well" at the bottom upon which a guitar base may be rested while the top or neck is retained by a notched-type restor holder.

U.S. Pat. No. 5,190,254 issued Mar. 2, 1993 to M. D. Maguire discloses a folding musical amplifier stand equipped with short sling type straps for supporting the amplifier.

U.S. Pat. No. 6,220,459 issued Apr. 24, 2001 to C. A. Runyon discloses a horn stand with two forked retainers for retaining in particular, a saxophone and which supposedly protects the sax from damage. The Runyon stand is nothing at all like the musical instrument stand of the present applicant.

OBJECTS OF THE INVENTION

It is an object of the invention to provide an instrument stand for convenient and safe storage of particularly brass wind instruments which will securely and safely hold such instrument in a performing venue readily but safely at hand for a musician's use.

It is a still further object of the invention to provide an instrument stand, which is soft and flexible so as not to harm a brass or similar instrument while such instrument is supported upon it.

It is a still further object of the invention to provide an instrument stand, which is conveniently folded into a compact package for carrying.

It is a still further object of the invention to provide an instrument support stand from which it is difficult to dislodge an instrument held thereupon.

It is a still further object of the invention to provide an instrument stand having a demountable feature or folding feature or arrangement by which the stand supports may be unfolded and mounted into support position by means of a few movements without complicated clamping or threading operations.

It is a still further object of the invention to provide an instrument stand, which is completely and effectively padded upon its instrument contact surfaces to prevent contact of a wind instrument with any possible marring surface.

It is a still further object of the invention to provide a wind instrument stand in which the support element of the stand adjusts itself to the shape of the instrument for superior support and protection.

It is a still further object of the invention to provide a wind instrument stand, which is relatively inexpensive, even though superior in supporting instruments.

It is a still further object of the invention to provide a wind instrument stand, which can be provided in several embodiments for different instruments and conditions.

It is a still further object of the invention to provide a musical instrument stand, which is easily and effectively held in condition for use by an elastic cord clamping arrangement, which can be easily disengaged.

It is a still further object of the invention to provide a musical instrument stand which by holding a delicate metal instrument in a sling-type arrangement further decreases the force exerted upon an instrument contained or held on the stand even if the stand should be accidentally kicked or stumbled over while supporting a delicate instrument.

Further objects and advantages of the invention will become evident from review of the following disclosures and specific descriptions in light of and reference to the appended drawings.

BRIEF DESCRIPTION OF THE INVENTION

A protective wind instrument stand is constructed from a pair of supporting rungs or bars mounted upon vertical supports connected by preferably padded beams or members between which a soft fabric sling is supported having a dependent center section. The side supports are preferably spaced from each other by spacer members extending between them and received in sockets in the vertical supporting members. The various members are held together by elastic bands arranged so that the cross-members can be conveniently unseated from the vertical members and folded together in a convenient bundle for carrying. In a second embodiment, the fabric sling itself is padded or both the sling and the beam are padded.

DETAILED DESCRIPTION OF THE INVENTION

Figure 1:
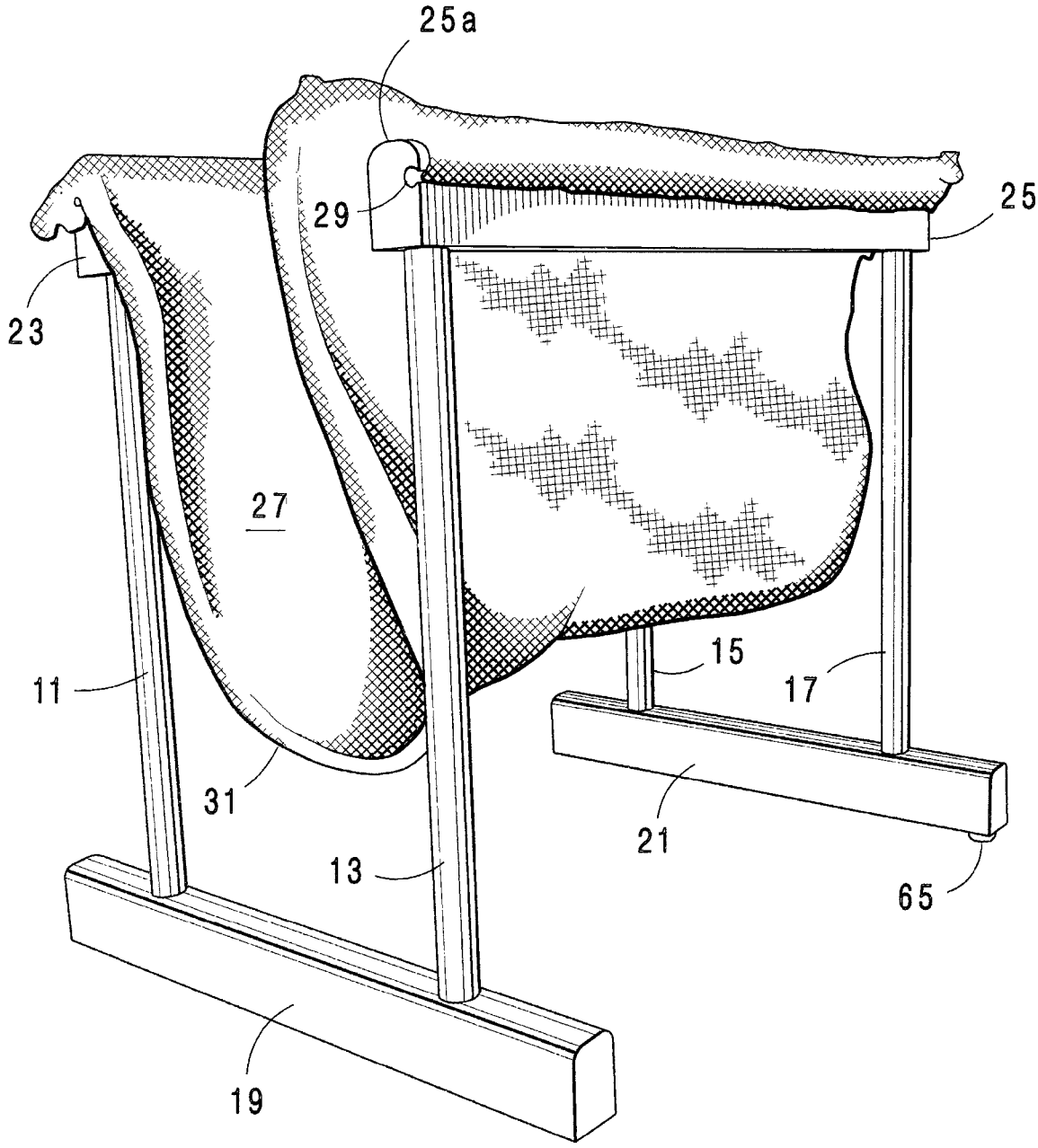
FIG. 1 is an oblique perspective view of the brass instrument holder of the invention from one end and side.

The following detailed description is of the best mode or modes of the invention presently contemplated. Such description is not intended to be understood in a limiting sense, but to be an example or examples of the invention presented solely for illustration thereof by reference to which in connection with the following description and the accompanying drawings one skilled in the art may be advised of the advantages and construction of the invention.

As indicated above, there have been various prior art musical instrument stands, which are designed to support various instruments when not in use, but also not in an instrument carrying case. Most of such stands have been constructed of metal in order to easily support the weight of large instruments, particularly of the brass family of wind instruments and have consequently had a tendency to scratch metal instruments, although such scratching or marking can be cushioned by laying sponge or cloth cushions between the metal stand parts and the delicate instrument parts, which expedient, however, is tedious and time consuming and takes considerable practice or skill to successfully accomplish. Furthermore, a stand padded for one instrument is frequently not suitable for another instrument and padding an entire stand adds unnecessary weight to the stand making in inconvenient to carry. Most of these stands fold at least to some extent to allow them to be carried more conveniently and may be provided with carrying cases, although this is frequently not resorted to. Such prior musical instrument stands have unfortunately not been as convenient as could be hoped and have furthermore been relatively costly.

Typically, present commercial stands for brass wind instruments are constructed so that the horn is supported upon three points of contact with the majority of the weight supported upon the two lower points. The total area of support is well under one inch with a corresponding likelihood that any sudden force applied upon the musical instrument will dent such instrument. In the so-called soft stand of the present invention, on the other hand, the area of support using the soft sling principle of the invention, there are easily 25 square inches of instrument contact and the instrument is directly supported with high quality polar fleece material with preferably a soft closed cell lining, lining the inside or instrument contacting side of the fleece material.

A further problem with most instrument stands is that the point of contact of the musical instrument with the stand is basically random unless great care is taken in placing the musical instrument in the stand and if a sensitive part such as a delicate slide is positioned at such point, serious damage can be accidentally caused.

In considering the problem of supporting musical instruments for safe retention when not in use, plus the frequent marring of the musical instruments stored by the stands available, or at least the perceived potential for marring, the present inventor has unexpectedly realized that a very satisfactory storage stand might be provided by a soft sling-type arrangement and has then proceeded to develop the stand or support of the present invention, which has proved eminently efficient and convenient for temporary support of brass wind instruments in particular for temporary support of instruments in a performing venue during temporary periods of disuse or non-use.

In accordance with the present invention, there is provided a wind instrument stand which is both unlikely to damage an instrument because it in effect provides a protective partial cocoon about at least the lower portions of the instrument plus can be easily partially disassembled and easily reassembled without complicated movements plus is easily carried and stored in a convenient carrying case.

In FIG. 1 there is shown a basic embodiment of the invention in which four vertical members 11, 13, 15 and 17, which will usually be formed from sections of tubing which may be of polished metal for more luxury versions of the invention or of partial metal or plastic tubing or even wooden posts for less expensive versions of the invention are shown mounted in two separate foot sections or base members 19 and 21, upon which the entire apparatus rests. In the drawings, the base members extend outwardly beyond the vertical support members or legs to provide additional side to side stability of the support stand.

At the top of the support stand are two longitudinal support members 23 and 25 which are secured to the top of the support members usually by means of a post and hole construction, i.e. a reduced end of a pole or post inserted into an orifice in the matching member. The top support members 23 and 25 have rounded tops 23 which serve as rails upon which a soft, pliable yet strong sheet of cloth 27 is stretched and usually as shown is attached to the rails by means of side grooves 29 into which the transverse edge sections of soft cloth extend. The grooves 29 are constricted at their opening and larger internally so that the soft, pliable and preferably stretchable or elastic cloth can be held by friction by the edges. The cloth 27 can be slid into the constricted entrance groove from the end or forced in by an instrument. Alternatively, the cloth may be secured by a strong adhesive or other fastening in grooves on the side. The tops 23*a* and 25*a* of the upper longitudinal members are rounded to remove longitudinal stress points along which the cloth might tend to tear when stressed or stretched by the weight of an instrument placed in a downwardly extending loop 31 between the longitudinal members 23 and 25.

Figure 2:
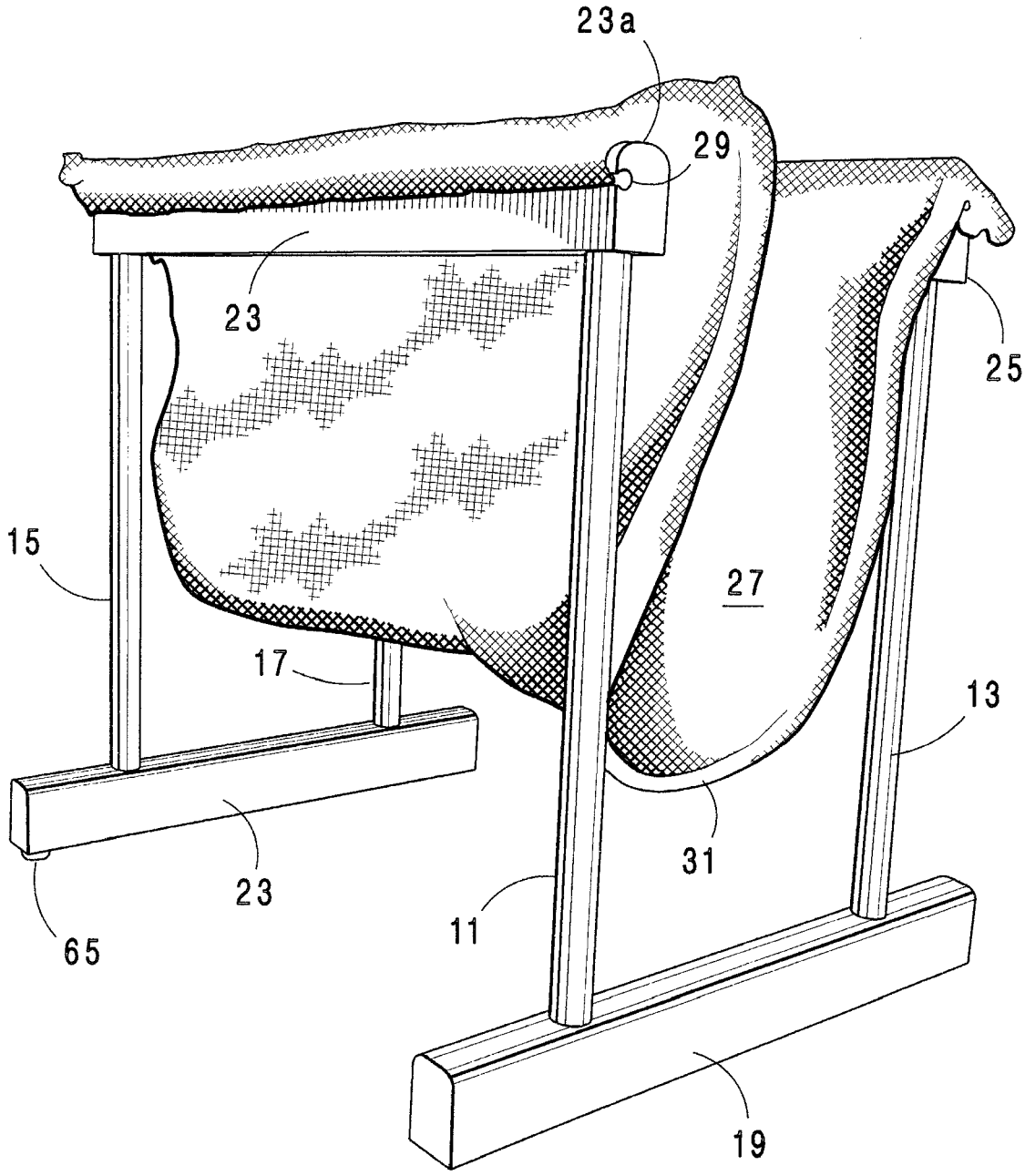
FIG. 2 is an oblique perspective view of the brass instrument holder of the invention from the same end, but opposite side from that shown in FIG. 1 of the brass instrument holder.

FIG. 2, which is an oblique view of the other side of the holder, shows that the cloth is attached to the opposite sides of both top rails in the same manner.

The cloth sling material 27 should be elastic or stretchable both to conform to the shape of the instrument and to improve in effect the softness of contact with a musical instrument in contact with it. A polyester fleece cloth has been found to be very satisfactory, but any soft flexible cloth having sufficient strength to support the musical instrument involved readily without danger of tearing will be satisfactory. As can be seen in FIG. 2, the two sides of the support are essentially symmetrical.

Figure 4:
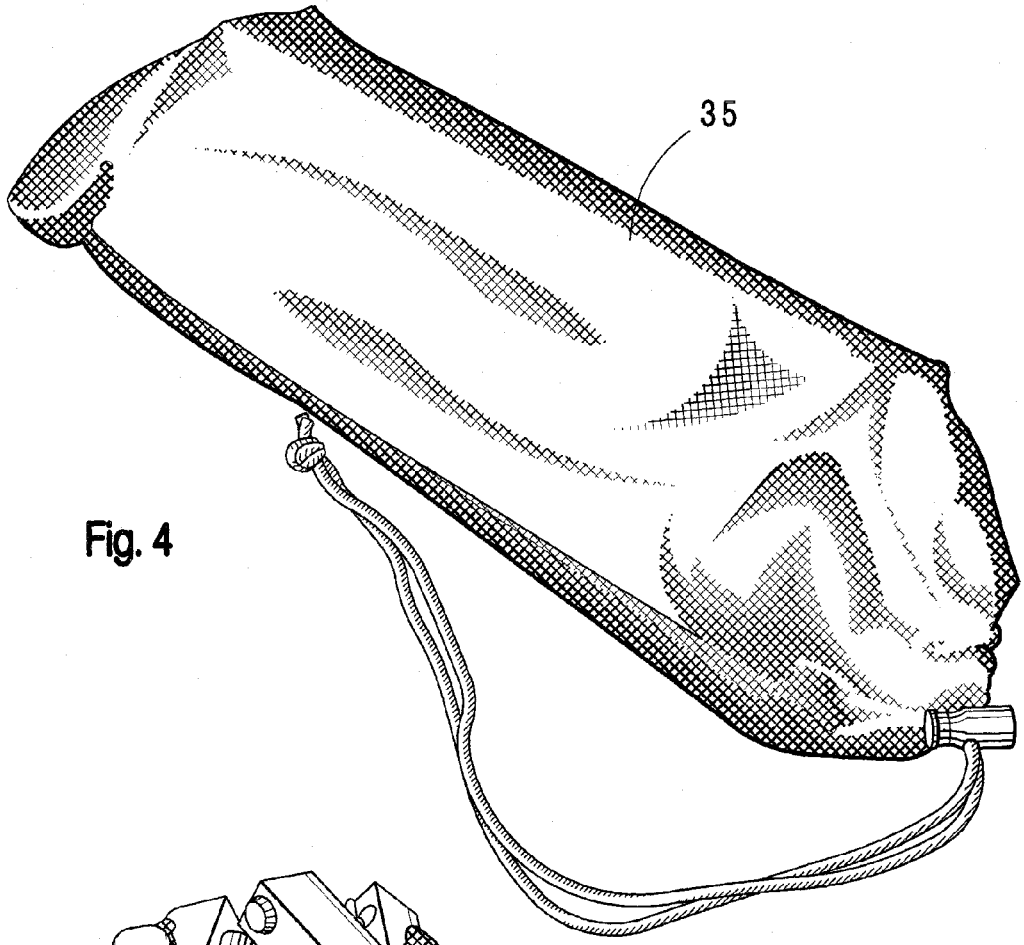
FIG. 4 is a perspective view of a carrying bag containing the folded instrument holder or stand.
Figure 3:
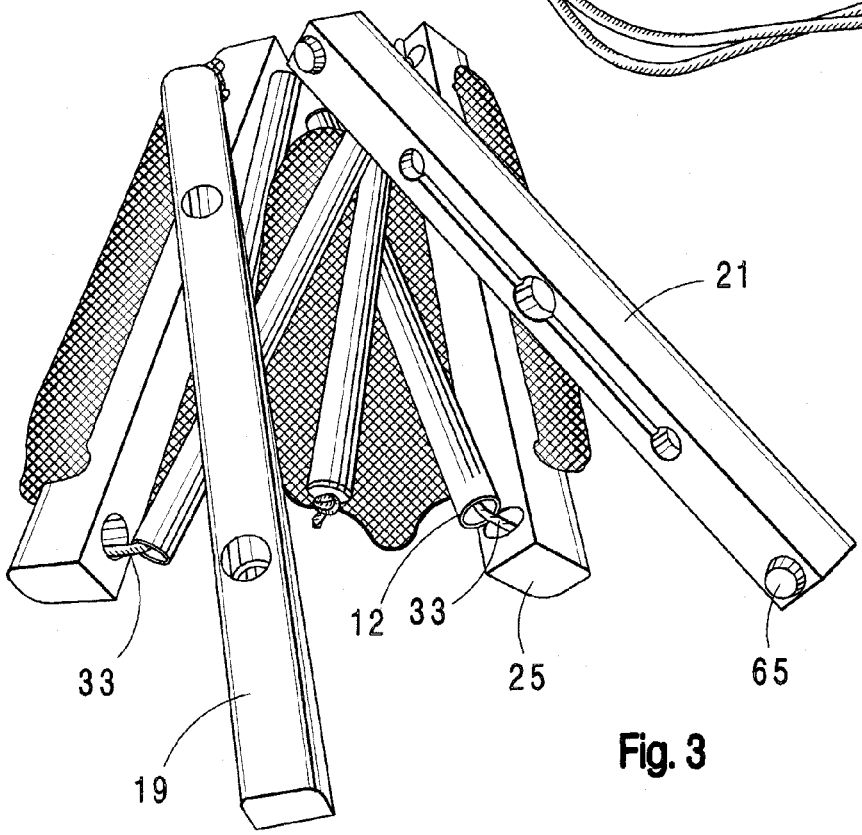
FIG. 3 is a perspective view of the holder shown in FIGS. 1 and 2 partially folded preparatory to placing in a carrier when not in use.

While the parts of the sling could be threaded together for easy erection and dismounting, or could be assembled and held together in any reasonably secure manner or in other ways, including even just snugly fitting the vertical members into matching orifices in the lower portions of the longitudinal rails 23 and 25, it has been found that a much easier and more satisfactory arrangement is to use flexible elastic cord to tie the various parts together. This can be accomplished in the following manner. A so-called bungee cord has been found to be very satisfactory. A bungee cord may be conveniently strung through hollows or tubular openings or other convenient openings in the vertical members from end to end through the hollow interior or alternatively through grooves in the surface of the members, or even along the surfaces clamped to or adhered to the surface in any suitable manner or by suitable means. However, the simplest and most convenient and efficient arrangement has been found to be to pass the bungee or other suitable elastic cord 33 through hollow sections particularly in the case of the vertical supporting members 11, 13, 15 and 17. The bungee cord may also be passed through orifices in the rails 21 and 23 and then to run in grooves on the bottom of foot sections 19 and 21. The cord holds the parts together when erected, but can be conveniently stretched to allow the vertical members to be extracted or pulled out of the longitudinal members and the foot sections and all the parts brought more or less parallel to each other in a compact bundle. This is shown in FIG. 3 where extended cord 33 passing between the parts may be seen and the individual longitudinally extended members are shown folded together more or less parallel to each other ready to be placed in the compact case or bag 35 shown in FIG. 4.

The instrument holder when folded with the various members more or less parallel to each other rather than at right angles when in erected condition can be easily slid into the case 35 and transported to another location where, if it is to be used to support the instruments for which it is designed, can be removed from the case 35, more or less spaced out and the ends of the vertical support members 3 to 9 placed in appropriate orifices which are clearly indicated by where the elastic or bungee cord leads and sit on its feet in position to receive a musical instrument in the sling 33 between the two upper longitudinal members.

As mentioned previously, an extra padded material, not shown, of any suitable sort may be placed on the rounded top of the upper longitudinal members or rails preferably under the soft stretchable cloth sling to further protect against any damaging contact with solid portions of the instrument stand of the invention. Alternatively, the inside of the sling may be lined with closed cell foam material or both padding arrangements may be combined.

Figure 5:
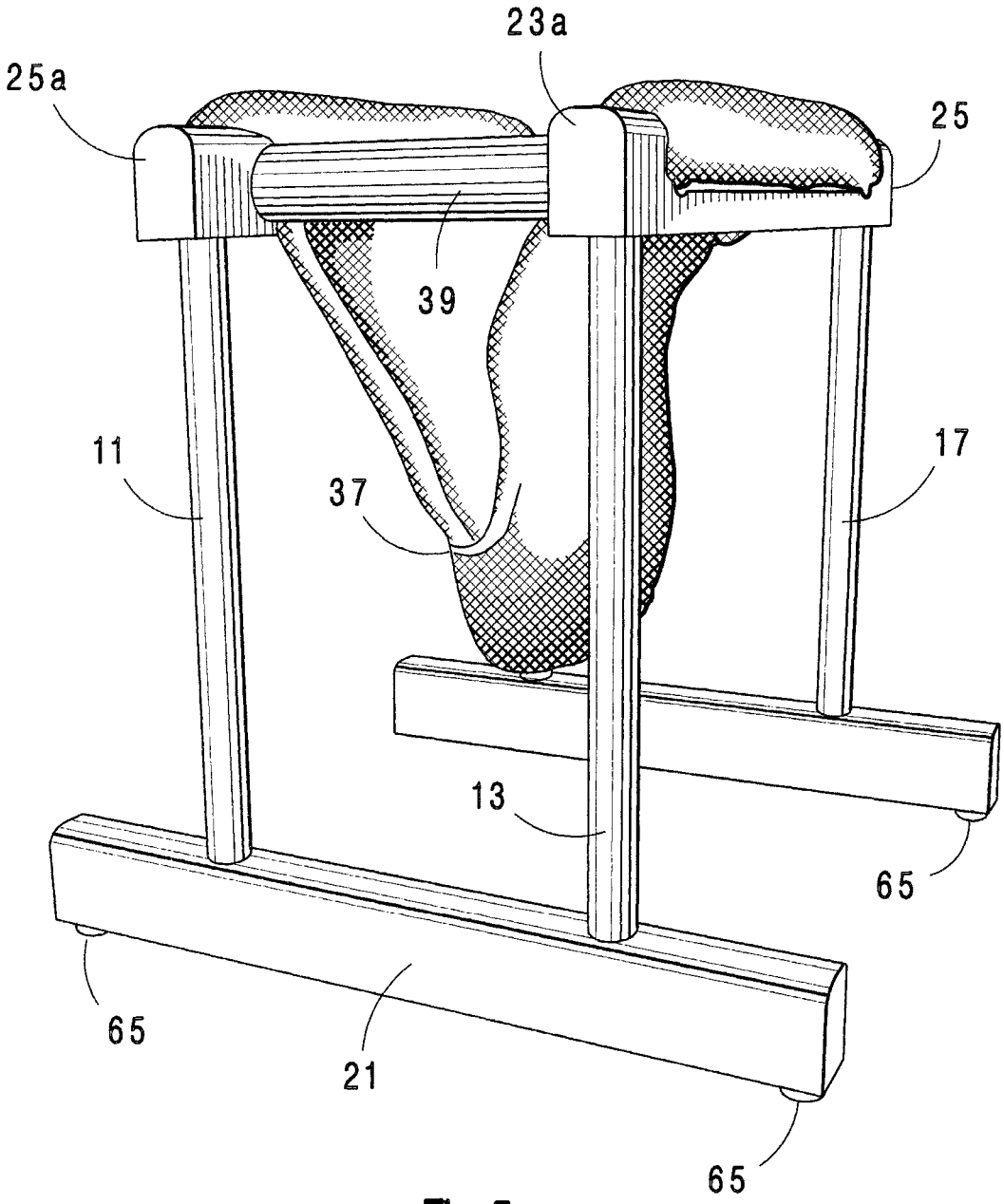
FIG. 5 is an oblique perspective view of an alternative embodiment of the instrument holder of the invention incorporating or having a preferred deep pocket configuration of soft instrument supporting material.

FIGS. 5 through 9 show a further embodiment of the invention which is particularly for a more longitudinally elongated instrument such as a trumpet, saxophone, tuba, euphonium, baritone horn or saxophone, or even in an extreme case a trombone and having a more vertically extended and cupped sling 37 between the crosspiece or support member 21 and 23. The sling 37 may be referred to as a "deep cup" sling, although its basic structure and support in the same as sling 27 in FIGS. 1-4, except that side groove 29*a* on the side of the longitudinal members or rails are shorter as seen in FIG. 5. See also FIG. 11, which shows the side of the rail by itself with the groove 29*a* in it. Such groove 29 is shown with drilled holes 29*b* on both ends of the grooves 29 to terminate such grooves and provide additional working room at the ends for better insertion of the cloth into the groove.

The deep cup sling shown in FIGS. 5 through 9 has the further advantage of further cushioning an instrument contained within it from damage by impact upon the stand such as someone stumbling over the stand in the often constricted space between musicians in a orchestra pit or on stage, since the sling can swing to the side if the stand is impacted automatically absorbing a portion of the force of the impact and further protecting the instrument from impact damage.

In addition, there are two crosspieces 39 and 41 at opposite ends of the musical instrument stand. These crosspieces 39 and 41 aid in strengthening and making the structure more rigid and preventing lateral movement of the longitudinal rails or support members 23*b* and 25*b* resulting from lateral tension from a heavier musical instrument held in the soft elongated sling 37. The arrangement for securing the parts together may be the same as shown in previous figures, i.e. an elastic cord may be run through or along the vertical members 11 through 17, the top rails 23 and 25 and along the foot or base members 21 and 23. The transverse crosspieces 39 and 41 for reinforcing the rails or longitudinal crosspieces against inward movement toward each other are not within the elastic cord or bungee cord loop because they have little tendency to become loosened during use. However, if it is desired to maintain them tied in effect to some of the elements of the stand they can be secured to the rest in the manner as shown in FIGS. 9 and 10 which show a preferred arrangement for securing the longitudinal or rail members 23 and 25 through the vertical members 11 through 17 to the foot members 19 and 21 where an elastic cord 37*a* is secured at one end and tied at the other end to secure the crosspieces to one longitudinal rail, which provides actually a preferred alternative manner of securing the vertical members to the longitudinal cross-members.

Figure 9:
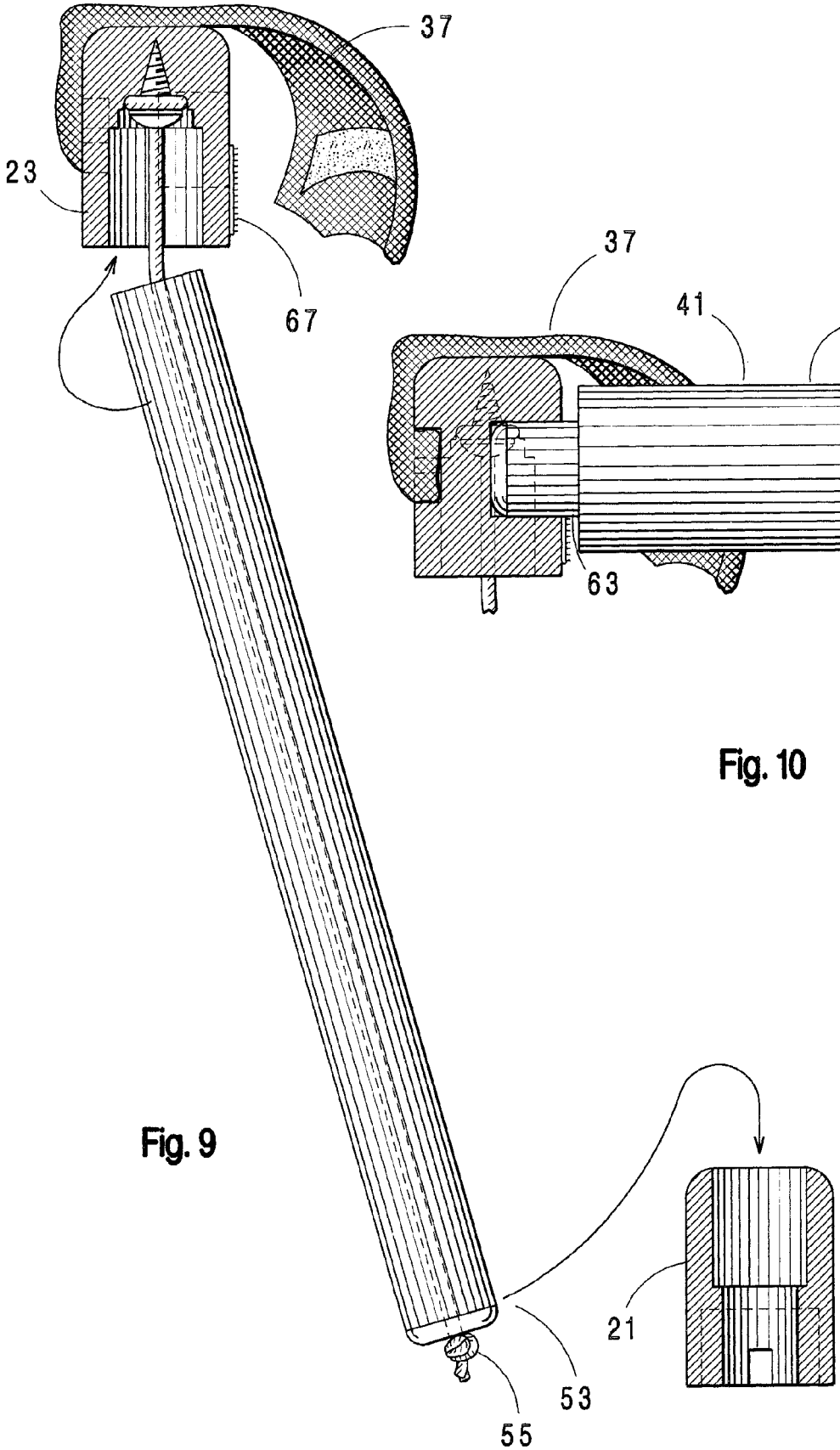
FIG. 9 is an enlargement of a crosspiece of the holder of the invention in a preferred arrangement of the invention showing a leg of the invention plus a cross-section through one of the fabric supporting crosspieces illustrating how an elastic cord serves to secure a leg in such crosspiece, plus a cross-section of one of the elongated feet of the stand. The leg as shown being retracted from the crosspiece.

While it is possible to use two complete loops of elastic cord or so-called bungee-type cord passing along the transverse rails in grooves not shown, then through the vertical members inside and then into the grooves on the feet or foot pieces a presently preferred arrangement of tying the parts together is shown in FIG. 9 in detail, the following arrangement is preferred.

Figure 10:
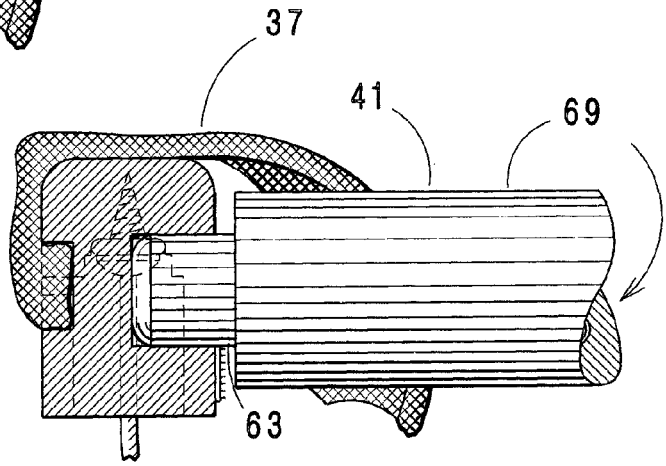
FIG. 10 is a cross-section of a crosspiece of the holder of the invention in accordance with FIGS. 5 through 10 at a point where an upper crosspiece passes into the fabric-supporting crosspiece.

In FIGS. 9 and 10, the elastic cord is shown bisected into an individual cord 47 the end of which is passed through a longitudinal orifice in a vertical support piece 43 and knotted on the end to prevent passage through the longitudinal orifice. The opposite end of the elastic cord is fastened by a threaded fastener 49 to the inside of one of the rails or longitudinal crosspieces. This is shown directly in FIG. 9 and in broken lines in FIG. 10 which also shown the outside end of one of the transverse crosspieces 39 or 41 notched into the longitudinal crosspiece.

Figure 6:
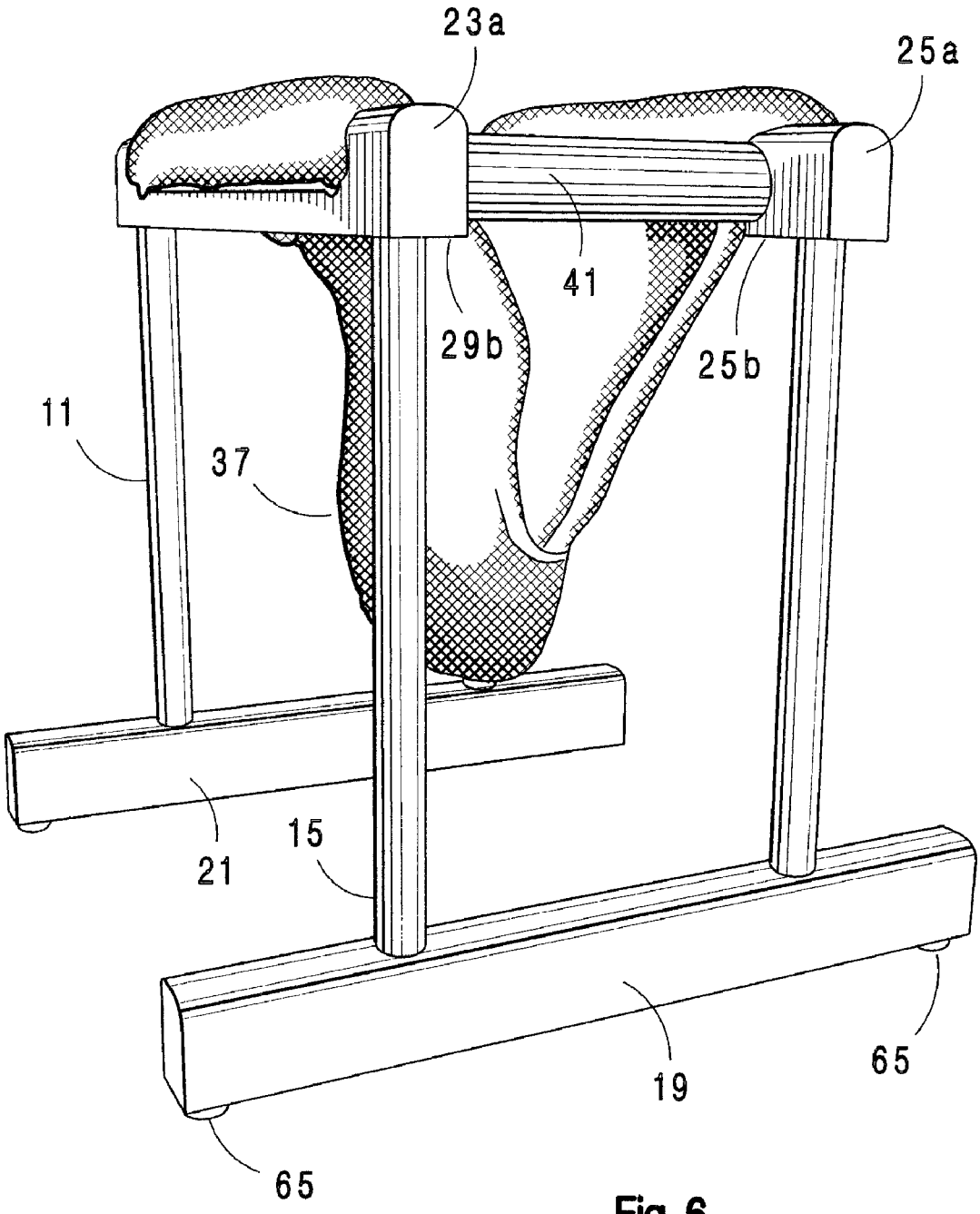
FIG. 6 is an oblique perspective view of the embodiment of FIG. 5 shown from the opposite side, and end with respect to FIG. 5.
Figure 8:
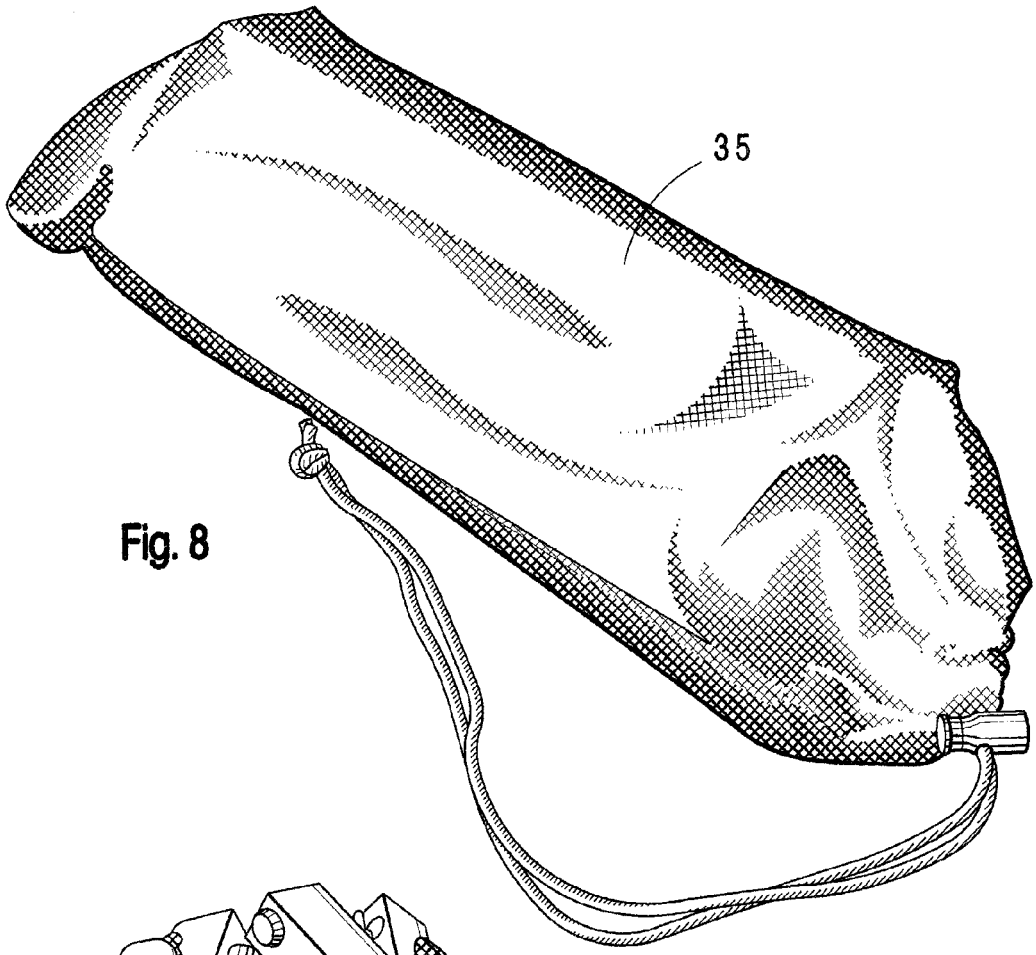
FIG. 8 is a perspective view of the instrument holder of FIGS. 5, 6 and 7 folded together and contained in a case.
Figure 7:
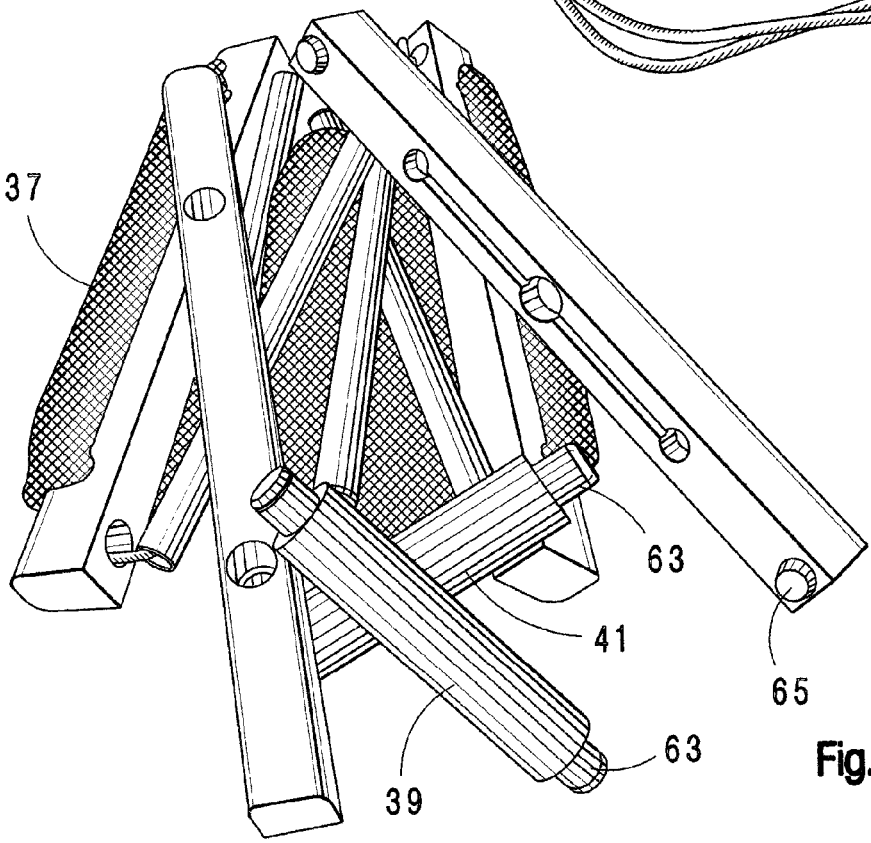
FIG. 7 is a perspective view of the embodiment of FIGS. 5 and 6 partially folded together.
Figure 11:
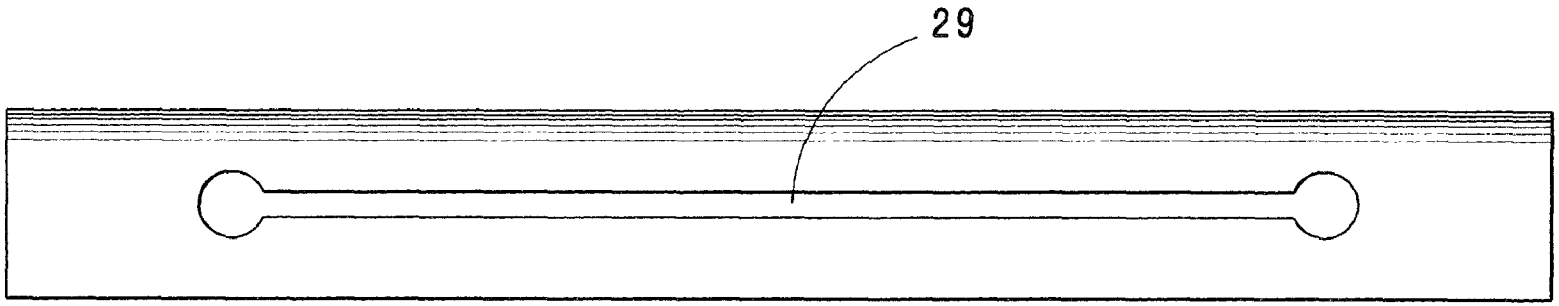
FIG. 11 is a side view of one of the longitudinal support sections of the stand of the invention showing orifices and grooves for receipt of one side of a soft flexible sling for support of a delicate musical instrument.
Figure 12:
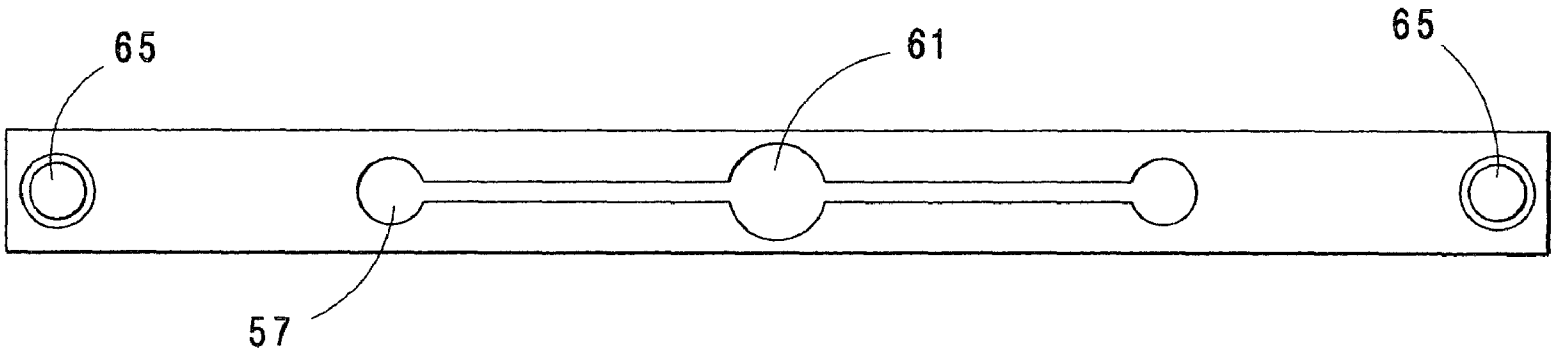
FIG. 12 is a bottom view of a foot section of the stand of the invention shown in FIG. 11 viewed from the bottom.

FIGS. 11 and 12 show respectively the side of the longitudinal rail in FIGS. 5 and 6 and the bottom of one of the foot sections 19 and 21 showing a groove 55 for the cord passage near the bottom of the foot, plus bottom-type surface contact means or buttons provided at the ends.

A more detailed description of the showing in FIGS. 9 and 10 follows:

The arrangement of the elastic cords within the hollow vertical supporting members in the applicant's preferred method of using elastic cords to tie to the music stand of the invention is shown in FIG. 9 and to some, but lesser extent in FIG. 10. At the top of FIG. 9, there is shown a cross-section of one of the top rails or longitudinal supporting members, in this case support members or rail 23. As shown, there is a round orifice 45 in the longitudinal section 23 at the location where vertical support member 11 will intersect with and be partially pushed or inserted into the rail 23. At the top of said round orifice 45 there is threaded into the wooden rail, a screw fitting having one end of an elastic cord 47 secured to it in any suitable manner either wrapped about a threaded fastening 49 and jammed against the surface of the inside of the round orifice or passed through a central orifice in the threaded fastening and out an orifice, not shown, and wrapped about the top of the threaded fastener 49 where it is jammed against the top of the orifice 45 by the flange or head 51 of the threaded fastening 49. The elastic cord then passes down through the hollow vertical support 11, passes through a retainer 53 on the opposite end, and is knotted as shown at 55. The lower end of the vertical supporting member may then be passed into a matching round orifice 57 in one of the foot pieces as shown in FIG. 9, the full foot piece being shown in FIG. 12 from the bottom. The assembler can reach into the bottom of the orifice in the foot piece or base member 21 and grasping the knot 55, pull the elastic cord downwardly through orifice 57 in the foot piece and then sideways along the groove 59 in the lower side of the foot piece and into the central orifice 61 in the base 21 at the end of the groove 59 in the base so the knot is stabilized in the central orifice 61 in its base 21. The foot pieces or base members are preferably provided with rubber or like material foot buttons 65 for actual contact with a supporting surface.

FIG. 10 shows a cross-section of longitudinal crosspiece 23 at a different point beyond the intersection with the vertical support 11 and shows the end of the crosspiece 41 where it intersects with the longitudinal rail 23 and illustrates the end 63 of the crosspiece 41 received in an orifice 63 in the rail or longitudinal crosspiece 21 with the threaded fastening shown in broken lines behind the end 63 of the crosspiece 41 received in the rail. The major portion of the diameter of the crosspiece away from the end 63 is a soft padding 69 to protect the surface of a musical instrument supported within the soft sling 27 which can be seen in partial sections passing downwardly behind the crosspiece 41. FIG. 10 also shows the upper end of the soft sling 37 received in a groove 29 within the rail, such groove 29 being more particularly shown in FIG. 11. The side of the rails or longitudinal crosspieces 23 and 25 are also preferably provided with a fastening of a hook and loop material 63 commonly known as Velcro® to maintain the elongated sling 37 more closely against the sides of rails 23 and 25.

Figure 13:
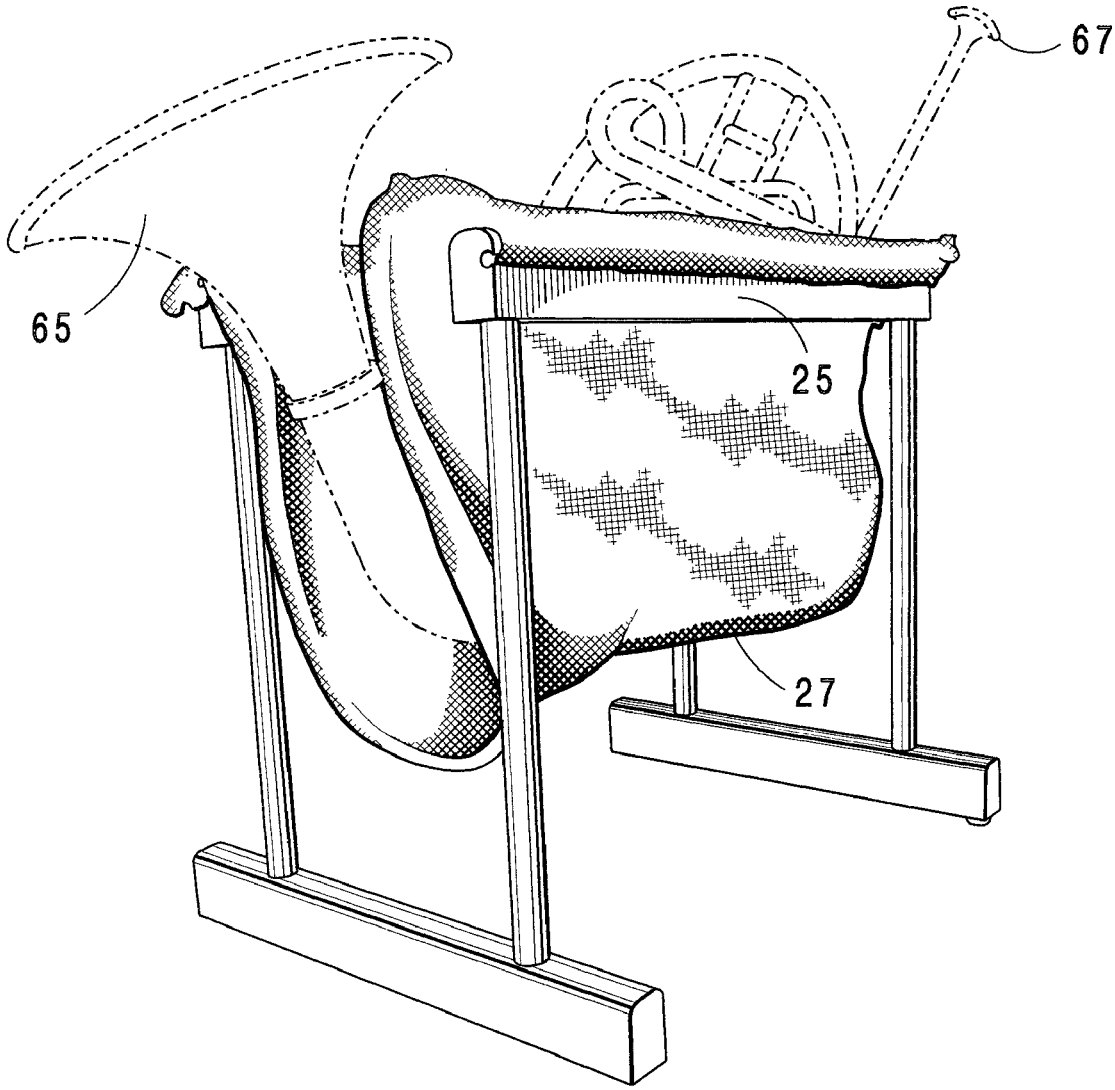
FIG. 13 is a perspective view of a typical French Horn resting in a stand in accordance with the invention designed for the support of French Horns.

FIG. 13 is a perspective view of a French Horn cradled in a stand of the present invention with the sling designed for widespread contact and support of a French Horn. In FIG. 13 a French horn 65 is shown inserted on its rear side into the soft cloth sling 27 of the invention hung supported from the padded longitudinal members 23 and 25, only the front member 25 of which is seen. The mouthpiece 67 of the horn extends upwardly. Such position of the horn enables it to be withdrawn from the holder in position to be immediately used, yet protects it from hard surfaces and retains it in the holder even in case of a bump or the like.

Figure 14:
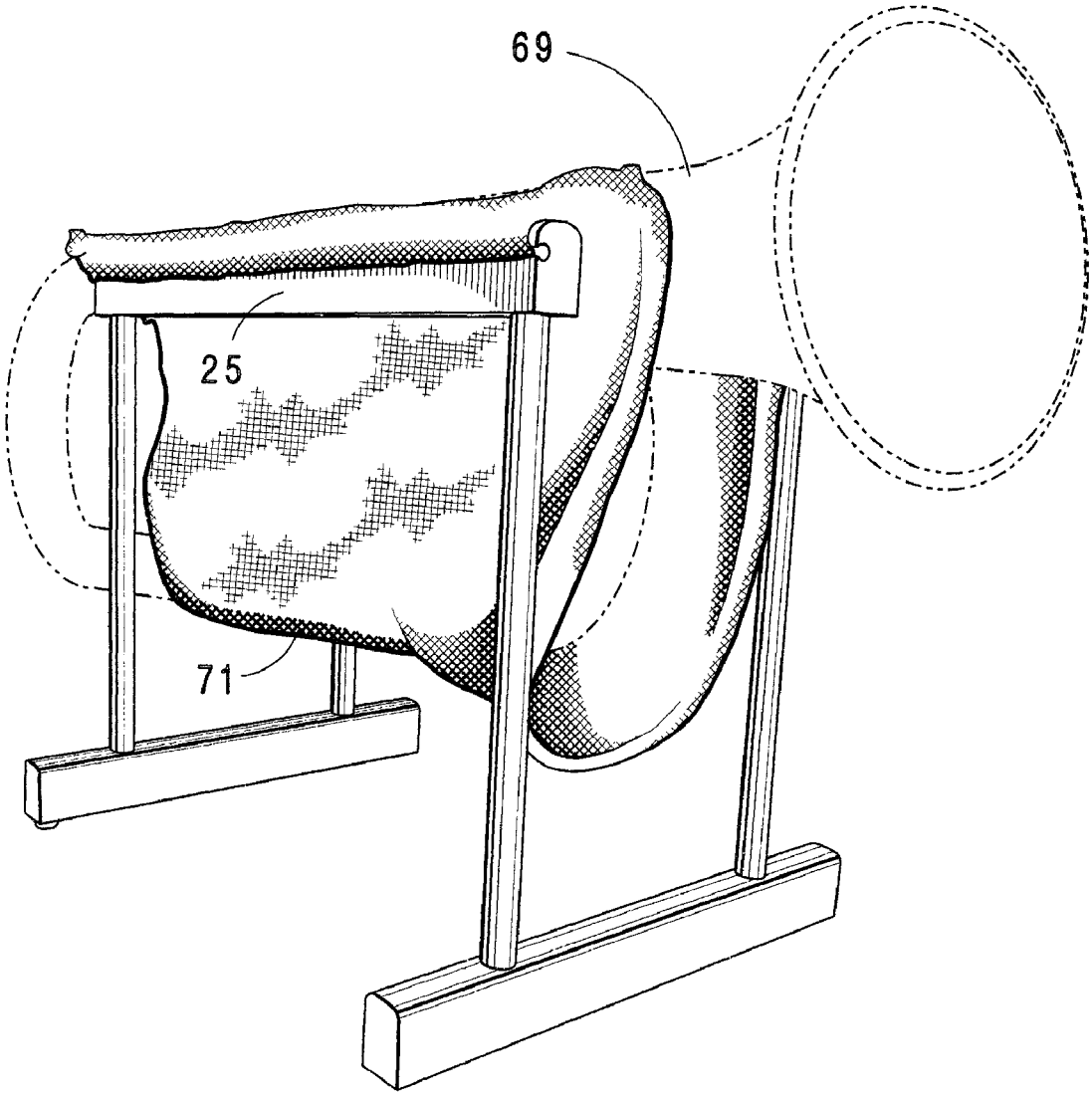
FIG. 14 is a perspective view of a typical euphonium held in a stand in accordance with the invention designed to support a euphonium.

FIG. 14 on the other hand, is a perspective view of a euphonium resting in a musical stand made in accordance with the present invention designed for support of such instrument. So called baritones with top valve construction can also be accommodated in such construction. FIG. 14 shows a euphonium horn 69 held in a somewhat different sling arrangement 71 having a straighter lower sling construction. As can be seen in FIGS. 13 and 14, the sling of the holder of the invention can be shaped or contoured to more or less match the brass instrument intended to be supported and retained in the holder, although in many cases, the type of horn supported can be changed easily with no modification of the sling because of the relatively stretchable material of which the sling is constructed, which will mold itself to the contour of the horn. As explained above, the sling will also be preferably padded either on the inside or within the portions attached to the cross pieces or both, such padding being preferably closed cell flexible plastic foam material.

One advantage of the instrument sling of the invention is that even in an erected state, the basic embodiment of FIGS. 1 through 4 can be easily lifted up and the two sides passed longitudinally of each other flattening the entire structure so the stand can be held in one hand in a more compact form. While this cannot be done with the embodiment of FIGS. 5 through 8 because of the crosspieces 39 and 41 which strengthen the rails against lateral movement caused by heavy instruments, the same partial pivoting and folding can be obtained by removing crosspieces 39 and 41. Note that when the structure is flattened in such manner for carrying or temporary storage, the two sides remain attached together by the sling material which also occurs when the stand is entirely dismounted and stored in the case 35 shown in FIGS. 4 and 8.

As will be evident, while a preferred embodiment of the invention have been described and shown, there are several other possible embodiments of the invention and it should not be understood that the invention is restricted to only those embodiments shown. The most important elements of the invention are namely the provision of a soft non-damaging sling-type holder for cradling musical instruments in a holder without contact with hard structural portions of a stand which may dent or otherwise damage the delicate thin walls of wind-type instruments, plus as a secondary element, the provision of preferably an elastic cord for tying at least some structural parts of a musical instrument stand together when disassembled from each other plus aiding in maintaining or holding them together when assembled.

While the present invention has been described at some length and particularly with respect to several described embodiments, it is not intended that it should be limited to any such particulars or embodiments or any particular embodiment, but is to be construed with reference to the appended claims so as to provide the broadest possible interpretation of such claims in view of the prior art and, therefore, to effectively encompass the intended scope of the invention.

I claim:

1. A holder for a wind instrument comprising:

a. four generally vertically oriented support members adapted for arrangement in a stable upright configuration, b. two longitudinal support members adapted to be mounted upon the upper portions of pairs of the generally vertically oriented support members to connect the said generally vertically oriented members together, c. the length of the two longitudinal support members being adapted to connect the pairs of generally vertically oriented support members at a distance which will encompass a musical instrument in at least the major dimensions of the lower portion of the instrument when arranged with a lower curvature of said instrument disposed downwardly, d. foot members mounted upon the lower ends of the generally vertically oriented support members at a distance which will encompass the musical instrument in a minor dimension of said instrument, e. a soft membrane having a strength sufficient to support the weight of the musical instrument attached on opposite sides of the soft membrane to the two upper longitudinal support members with sufficient slack to hang at least partially downwardly between the longitudinal support members, such as to securely support in a stable position, a musical instrument placed thereupon, f. the ends of the longitudinal support members and the foot members being adapted for temporary connection with the generally vertically oriented support members during use of the wind instrument holder to support the soft membrane and musical instruments placed thereupon.

2. A holder for a wind instrument in accordance with claim 1 additionally comprising orifices in the longitudinal support members and foot members to receive and stabilize the position of the longitudinal members.

3. A holder for a wind instrument in accordance with claim 2 additionally comprising an elastic member extending in relation to the longitudinal members and the generally vertically oriented support members such as to bind such members into a structural relationship able to support the weight of the assembled structure plus the weight of a wind instrument supported upon the soft membrane, said elastic having sufficient stretch to enable the generally vertically oriented support members to be extracted from the orifices in the crossmembers and foot members allowing folding of the components together.

4. A holder for a wind instrument in accordance with claim 3 wherein the elastic member extends substantially parallel to the longitudinal members and through orifices in the generally vertically oriented support members.

5. A holder for a wind instrument in accordance with claim 4 wherein the elastic member is confined in a hollow in the generally vertically oriented members.

6. A holder for a wind instrument in accordance with claim 5 wherein the longitudinal opening is a groove in the longitudinal members.

7. A holder for a wind instrument in accordance with claim 5 wherein the generally vertically oriented support members are attached to elongated foot members containing grooves for receipt of elastic members.

8. A holder for a wind instrument in accordance with claim 1 additionally comprising a soft padding material at least partially surrounding the longitudinal support members and between the longitudinal support members and the soft membrane to further cushion any contact with an instrument.

9. A holder for a wind instrument in accordance with claim 3 additionally comprising:

g. transverse upper crosspieces extending between the ends of the longitudinal support members to strengthen the upper rigidity of the longitudinal crosspieces against the weight of heavier instruments.

10. A holder for a wind instrument in accordance with claim 9 wherein the transverse upper crosspieces are padded to protect a musical instrument held in the soft sling.

11. A holder for a wind instrument in accordance with claim 1 wherein the foot members extend outwardly beyond the generally vertically oriented member receiving orifices in the foot members in order to provide additional stability.

12. A holder for a wind instrument in accordance with claim 2 in which the soft cloth sling secured to the longitudinal support members extends downwardly in a curved cup arrangement so as to support the instrument in the soft cloth sling in a cup-type arrangement.

13. A holder for a wind instrument in accordance with claim 12 wherein the downwardly extending curved cup portion of the sling has sufficient slack to swing to the side to reduce impact force upon the instrument if the holder is externally impacted.

14. A holder for a wind instrument in accordance with claim 13 wherein the sling material is overlain on the inside portion of the sling with a supplemental padding material.

* * * * *